US011584553B2

(12) United States Patent
Tarozzi

(10) Patent No.: US 11,584,553 B2
(45) Date of Patent: Feb. 21, 2023

(54) METHOD FOR MAKING AN AIRTIGHT WRAPPER AND AIRTIGHT WRAPPER THUS OBTAINED

(71) Applicant: I.M.A. INDUSTRIA MACCHINE AUTOMATICHE S.P.A., Ozzano Dell'Emilia (IT)

(72) Inventor: Luca Tarozzi, Ozzano Dell'Emilia (IT)

(73) Assignee: I.M.A. INDUSTRIA MACCHINE AUTOMATICHE S.P.A., Ozzano dell'Emilia (IT)

( * ) Notice: Subject to any disclaimer, the term of this patent is extended or adjusted under 35 U.S.C. 154(b) by 300 days.

(21) Appl. No.: 16/639,730

(22) PCT Filed: Aug. 13, 2018

(86) PCT No.: PCT/IT2018/050154

§ 371 (c)(1),
(2) Date: Feb. 17, 2020

(87) PCT Pub. No.: WO2019/035148

PCT Pub. Date: Feb. 21, 2019

(65) Prior Publication Data

US 2021/0122508 A1 Apr. 29, 2021

(30) Foreign Application Priority Data

Aug. 17, 2017 (IT) ..... 102017000093993

(51) Int. Cl.
*B65B 19/22* (2006.01)
*B65B 11/00* (2006.01)
*B65D 85/10* (2006.01)

(52) U.S. Cl.
CPC ..... *B65B 19/22* (2013.01); *B65B 11/004* (2013.01); *B65D 85/1018* (2013.01)

(58) Field of Classification Search
CPC ..... B65B 19/02; B65B 19/22; B65B 11/004; B65B 11/48; B65B 11/10; B65D 85/1018; B65D 85/10

(Continued)

(56) References Cited

U.S. PATENT DOCUMENTS 2,994,167 A * 8/1961 Chalmers ..... B65B 19/02 53/462
2011/0084120 A1* 4/2011 Biondi ..... B65D 77/02 229/87.13

FOREIGN PATENT DOCUMENTS

WO WO-2009/0130227 A1 10/2009
WO WO-2011/032625 A1 3/2011
WO WO-2016/087828 A1 6/2016

OTHER PUBLICATIONS

International Search Report and Written Opinion for PCT/IT2018/050154, dated Nov. 7, 2018.

* cited by examiner

*Primary Examiner* — Rafael A Ortiz
(74) *Attorney, Agent, or Firm* — Marshall, Gerstein & Borun LLP

(57) ABSTRACT

An airtight wrapper having an assembly wrapped by a wrapping sheet made of a weldable material creating a group of smoking articles obtained by:
positioning the folded wrapping sheet to contact walls, front rear and head wall of the assembly, with flaps protruding beyond bottom and lateral walls;
welding lower and upper flaps, and defining a transverse edge;
folding the welded transverse edge rotating it by 180° toward the front wall;
folding the upper and lower transverse flaps;
folding the upper and lower transverse flaps;

(Continued)

folding the rear and front longitudinal flaps, and partly also the transverse edge, toward the lower lateral walls, overlapping one on top of the other above the transverse flaps, and finally welding them to seal the airtight wrapper.

14 Claims, 3 Drawing Sheets

(58) Field of Classification Search
USPC ..... 206/271, 272, 274, 275, 242
See application file for complete search history.

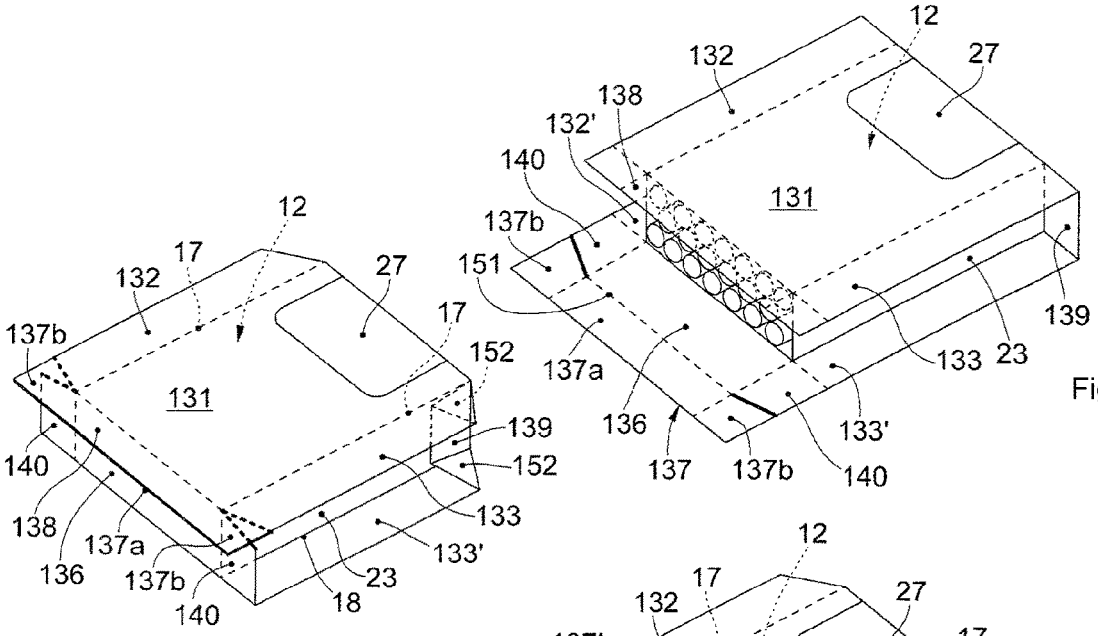
Fig. 4a
Fig. 4b
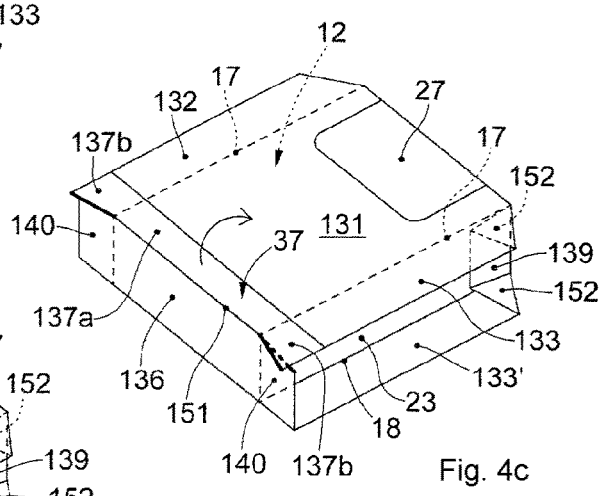
Fig. 4c
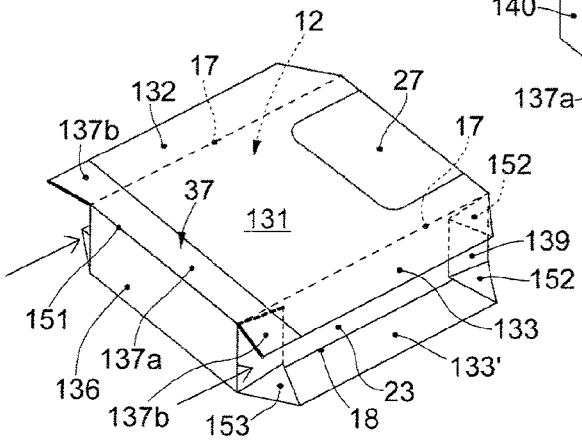
Fig. 4d
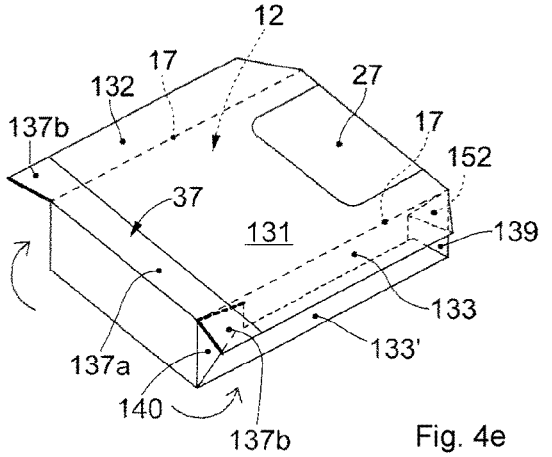
Fig. 4e
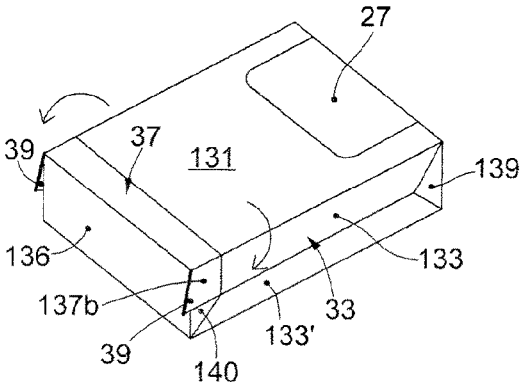
Fig. 4f

METHOD FOR MAKING AN AIRTIGHT WRAPPER AND AIRTIGHT WRAPPER THUS OBTAINED

FIELD OF THE INVENTION

The present invention concerns a method to make an airtight wrapper in the field of packets of smoking articles. In particular, the method allows to create an airtight wrapper of the envelope type around a group of smoking articles.

The present invention also concerns an airtight wrapper for smoking articles.

BACKGROUND OF THE INVENTION

Smoking articles are traditionally packed in rigid or semi-rigid packets, inside which the smoking articles are wrapped in an internal wrapper, generally made of tinfoil.

Normally, a reinforcement insert or collar is present in cooperation with the internal wrapper.

This form of wrapper represents a compromise solution between production costs and the need to maintain unaltered the organoleptic characteristics of the tobacco present in the smoking articles.

In order to better preserve the qualities of the smoking articles, the need is increasingly felt to make a sealed internal wrapper, that is, obtained with a sheet of material that does not allow air to pass, suitably welded and sealed around the group of smoking articles contained in it.

It is difficult to make the welds which generate the seal, since the smoking articles located inside the wrapper can be subjected to mechanical and thermal stresses which could deform them or deteriorate the tobacco inside them.

Moreover, if not well executed, the seal can leave even minimal apertures.

To overcome some of these problems, at least partly, it is known to use a reinforcement insert made of cardboard. The reinforcement insert is disposed inside the internal wrapper and at least partly surrounds the group of smoking articles, so as to maintain the correct configuration of the internal wrapper and to protect the smoking articles.

In order to perform welds coherent with the seal it is necessary to fold the wrapping sheet in advance, so as to completely wrap the group of smoking articles associated with the respective reinforcement insert.

Solutions are known that provide to position the U-shaped wrapping sheet around a structured assembly given by the combination of a reinforcement insert partly wrapped around a group of smoking articles and then to fold the wrapping sheet around the structured assembly in such a way as to wrap it completely.

In particular, document US-A-2011/084120 is known, which describes a method to make a wrapper for a cigarette packet having an airtight sealed internal wrapper, with a stiffening reinforcement. This document provides to position a wrapping sheet, folded in a U shape, with respect to a structured assembly comprising the cigarettes, in such a way as to define a first larger panel and a second larger panel of the wrapping sheet in contact with respective larger walls, front and rear, of the structured assembly, and a first smaller panel of the wrapping sheet in contact with a smaller head wall of the structured assembly. In this prior art document, the wrapping sheet, once positioned with respect to the structured assembly, has respectively: an upper flap connected to the first larger panel and a lower flap connected to the second larger panel, with the lower flap protruding beyond a smaller bottom wall of the structured assembly, upper transverse flaps connected to the first smaller panel, and protruding laterally from the smaller head wall, rear and front longitudinal flaps, respectively connected laterally to the first larger panel and to the second larger panel and protruding beyond respective smaller lateral walls of the structured assembly.

Documents WO-A-2009/130227, WO-A-2011/032625 and WO-A-2016/087828, which describe methods for making wrappers for cigarette packets are also known.

One disadvantage of known solutions is that, during the wrapping of the wrapping sheet around the structured assembly, unwanted folds can form which, besides making the aesthetic appearance of the wrapper aesthetically unpleasant, can give an incorrect watertight welding of the wrapper.

One purpose of the present invention is to perfect a method to make a wrapper which at least partly overcomes the disadvantages of the state of the art.

Another purpose of the present invention is to perfect a method to make a wrapper with ordered and uniform folds and which is aesthetically pleasing.

Another purpose of the present invention is to perfect a method for producing, precisely and quickly, an airtight wrapper around a structured assembly consisting of a group of smoking articles partly wrapped by a reinforcement insert, obtaining high productivity.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

Embodiments described here concern a method to make an airtight wrapper comprising a structured assembly completely wrapped by a wrapping sheet. The structured assembly comprises an organized group of smoking articles partly wrapped by a reinforcement insert.

The reinforcement insert can be obtained from a preformed cardboard sheet, folded in such a way as to define a base wall and two lateral walls which extend parallel to each other from the base wall, and which define, during use, the lateral containing walls of the organized group of smoking articles.

The structured assembly can have a parallelepiped shape, comprising a larger rear wall defined by the smoking articles, a larger front wall defined by the base wall of the reinforcement insert, two smaller lateral walls defined at least partly by the lateral walls of the reinforcement insert, a smaller head wall defined by the ends of the filters of the smoking articles and a smaller bottom wall defined by the ends of the smoking articles opposite the filters.

To make the airtight wrapper around the structured assembly, the method provides to fold a wrapping sheet made of weldable material into a "U" shape and position it around three sides of the structured assembly.

In this way, a first larger panel and a second larger panel of the wrapping sheet are defined, in contact with the larger front and rear walls of the structured assembly, and a first smaller panel in contact with the head wall of the structured assembly.

After positioning, the wrapping sheet has an upper flap, connected to the first larger panel, and a lower flap, connected to the second larger panel, which protrude beyond the smaller bottom wall, upper transverse flaps, connected to the first smaller panel and protruding laterally from the smaller head wall, and the rear and front longitudinal flaps, respectively connected laterally to the first larger panel and to the second larger panel, and which protrude beyond respective smaller lateral walls.

The method also provides to move the lower flap and the upper flap nearer to each other and to weld them to each other so as to define a transverse edge, substantially aligned with the larger front wall.

The lower and upper flaps, brought nearer and overlapping each other, also define a second smaller panel, disposed folded, adjacent to the lower bottom wall, between the larger panel and the lower flap, to which it is connected by a transverse folding line, and lower transverse flaps, connected to the second smaller panel and protruding laterally from the lower bottom wall and opposite the upper transverse flaps.

The method also provides to fold the transverse edge welded onto the first larger panel, rotating it by 180° along the transverse folding line.

The method also provides to fold the upper and lower transverse flaps of the wrapping sheet toward the smaller lateral walls, and to fold the rear and front longitudinal lateral flaps toward the lateral walls, overlapping them over each other, and also part of the transverse edge, above the transverse flaps.

Finally, the whole is welded in correspondence with the smaller lateral walls to achieve the sealing of the airtight seal.

The method to make an airtight wrapper according to the invention provides to make at least two cuts in the wrapping sheet which allow both to innovate and improve the folding technique thereof around the structured assembly, and also to obtain an improved result.

In particular, the method according to the invention provides to make cuts which define two free lateral fins and a central portion in the lower flap.

According to some embodiments, the cuts are made in a position such as to separate the lower flap from the respective lower transverse flaps, before folding the latter, so as to be able to fold them freely with respect to the lower flap and therefore with respect to the transverse edge.

According to some embodiments of the invention, the cuts can be made advantageously before the wrapping sheet is associated with the structured assembly.

According to possible variant embodiments, the cuts can be made after having associated the wrapping sheet to the structured assembly, and before folding the lower transverse flaps.

The presence of the cuts allows to disconnect at least the lower flap, and therefore the transverse edge, from the respective lower transverse flaps, so that, operating on the first, the second are not conditioned, and vice versa.

The cuts therefore allow to fold the lower transverse flaps autonomously and independently, without involving the transverse edge, which remains free in its position.

In this way, the fold of the lower transverse flaps is linear and well defined, and no wrinkling effects of the welded transverse flap, or unwanted folds, are produced.

According to another aspect of the invention, during the folding of the front longitudinal flaps, the method provides to overlap the lateral fins over the longitudinal flaps in a planar and extended shape, without substantial deformations.

In this way a better overlapping of the longitudinal and transverse flaps is obtained, and therefore a larger reciprocal contact area, which allows a better sealed weld, preventing the formation of even minimal openings which could compromise the sealing.

According to some embodiments, the cuts can be made in continuity with the transverse folding line and parallel thereto.

According to possible variant embodiments, the cuts can be made inclined, with respect to the transverse folding line, by an acute angle larger than zero, and symmetrical to one another with respect to a longitudinal axis of the wrapping sheet.

According to a variant, further incisions, cuts, or cutting lines can also be provided between each lower transverse flap and the respective rear longitudinal flap.

According to another variant, further incisions, cuts, or cutting lines can also be provided in correspondence with one or both sides of the upper transverse flaps in correspondence with the first smaller panel which is positioned adjacent to the upper wall of the structured assembly, so as to increase the contact area between overlapping longitudinal flaps and guarantee a better airtight seal.

Embodiments described here also concern an airtight wrapper comprising a structured assembly completely wrapped by a wrapping sheet made of weldable material, in which the structured assembly comprises a group of smoking articles partly wrapped by a reinforcement insert.

The airtight wrapper comprises front and rear larger lateral walls, parallel and opposite one another, and connected on one side by smaller lateral walls parallel and opposite one another, and on the other side by a respective upper and lower wall, parallel and opposite each other.

According to the invention the airtight wrapper comprises a transverse edge, folded over the larger front lateral wall, and formed by a lower flap and an upper flap of the welded wrapping sheet overlapping each other, wherein the upper flap is disposed between the front larger lateral wall and the lower flap.

According to another aspect of the present invention, the lower flap comprises a central portion connected to the lower wall, and lateral fins disposed on one side and the other of the central wall, separated by cuts from respective lower transverse flaps protruding from the lower wall and folded on the lateral walls, in which the lateral fins are overlapping in a planar and extended shape, without substantial deformations, on the lateral walls.

BRIEF DESCRIPTION OF THE DRAWINGS

These and other characteristics of the present invention will become apparent from the following description of some embodiments, given as a non-restrictive example with reference to the attached drawings wherein:

FIGS. 4*a* to 4*f* schematically show the steps of folding the wrapping sheet in FIG. 3 around the structured assembly in FIG. 2;

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
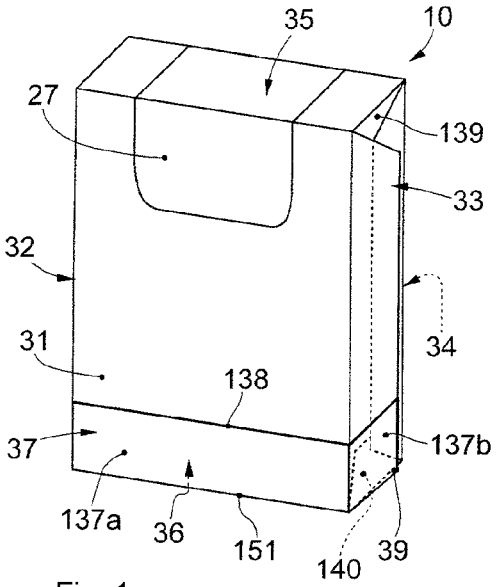
FIG. 1 is a schematic three-dimensional view of an airtight wrapper according to embodiments described here.

Embodiments described here concern a method to make an airtight wrapper 10, 20 comprising a structured assembly 12 completely wrapped by a wrapping sheet 110, 120. The structured assembly 12 comprises at least one organized group of smoking articles 14 and a reinforcement insert 16.

Figure 2:
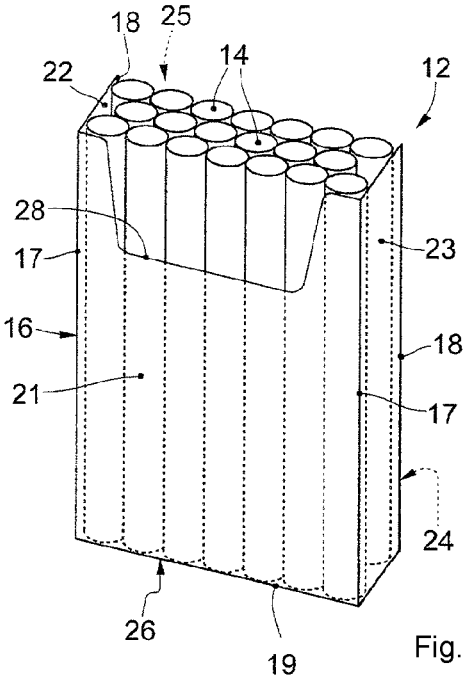
FIG. 2 is a schematic three-dimensional view of a structured assembly given by the combination of a reinforcement insert partly wrapped around a group of smoking articles.

According to the embodiment shown for example in FIG. 2, the reinforcement insert 16 is disposed so as to wrap the smoking articles 14 on at least three sides.

The reinforcement insert 16 can be obtained from a preformed cardboard sheet, folded in such a way as to define a base wall and two lateral walls which extend parallel to each other from the base wall, and which respectively define a larger front wall 21 and the smaller lateral walls 22, 23 of the structured assembly 12.

In particular, the reinforcement insert 16 can be made as a U-shaped containing element, thus wrapping on three sides the smoking articles 14, or U-shaped with one or two further flaps parallel to the base wall and protruding from the upper ends of the lateral walls, thus at least partly surrounding the smoking articles 14 also on a fourth side.

The structured assembly 12 also comprises a larger rear wall 24, opposite the larger front wall 21, defined, for example, by lateral surfaces of the smoking articles 14, and two smaller walls, head 25 and bottom 26, opposite them, and defined respectively by the two ends of the smoking articles 14.

The larger front wall 21 can have a shaped edge, or collar 28 which, in the airtight wrapper 10, 20, can cooperate with an aperture to extract the smoking articles 14, possibly present first in a wrapping sheet 110, 120 and then in the airtight wrapper 10, 20.

In accordance with some embodiments, described with reference to FIG. 1, the airtight wrapper 10 comprises a larger front lateral wall 31, which overlaps the larger front wall 21, a larger rear wall 34, which overlaps the larger rear wall 24, and smaller lateral walls 32, 33 which overlap the smaller lateral walls 22, 23 of the structured assembly 12.

The airtight wrapper 10 also comprises an upper wall 35 and a lower wall 36, which are respectively associated with the lower head 25 and bottom walls 26 of the structured assembly 12.

The airtight wrapper 10 according to the invention, in correspondence with each smaller lateral wall 32, 33, has transverse flaps and longitudinal lateral flaps, folded and overlapping each other and welded together.

The airtight wrapper 10 according to the invention also comprises a fin, or transverse edge 37 folded over the larger front lateral wall 31, and formed by a lower flap 137 and an upper flap 138 of the wrapping sheet 110 welded overlapping each other, in which the upper flap 138 is disposed between the larger front lateral wall 31 and the lower flap 137.

According to some embodiments, shown for example in FIG. 1, the transverse edge 37 at least partly surrounds a lower portion of the larger front wall 31 and the smaller lateral walls 32, 33.

According to some embodiments, the lower flap 137 comprises a central portion 137*a* connected to the lower wall 36 by a transverse folding line 151, and lateral fins 137*b* disposed on one side and the other of the central portion 137*a*, and separated by cuts 145 from respective lower transverse flaps 140 protruding from the lower wall 36 and folded over the smaller lateral walls 22, 23 of the structured assembly 12.

According to some embodiments, the lateral fins 137*b* overlap in a planar and extended shape on the smaller lateral walls 32, 33.

According to some embodiments, the lateral fins 137*b* are disposed on the smaller lateral walls 32, 33 without substantial deformations, or at most they can have deformations due to subsequent handling or welding.

Figure 3:
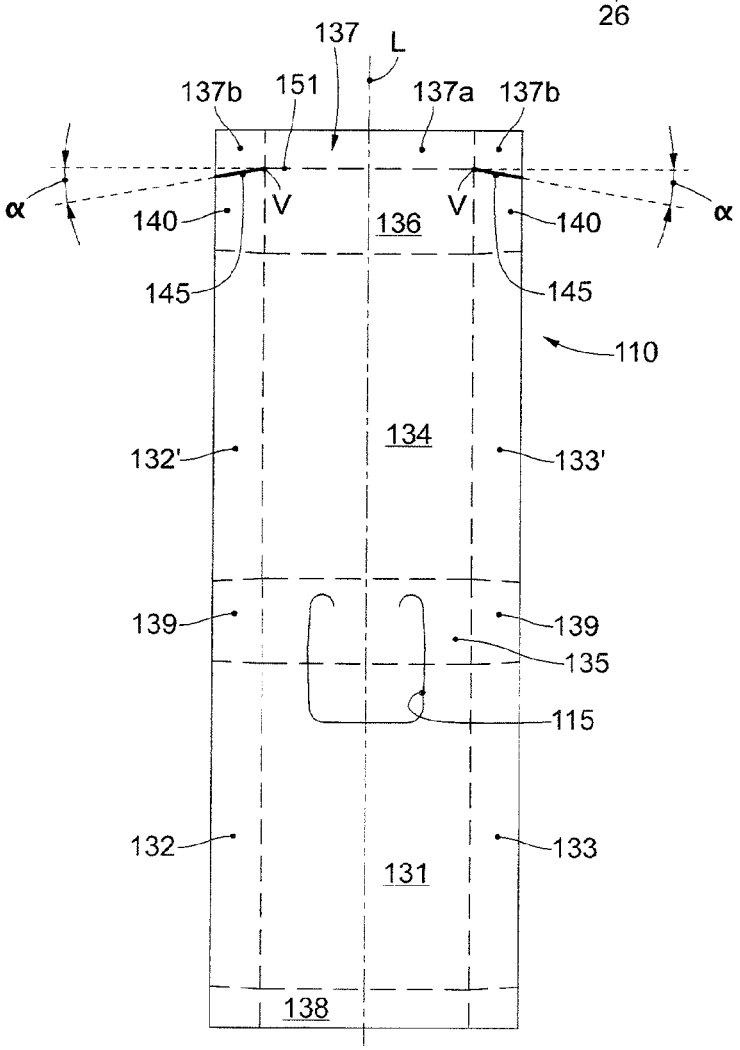
FIG. 3 is a schematic view of a wrapping sheet used to make the airtight wrapper in FIG. 1 with the flaps and folds that form during folding around the structured assembly in FIG. 2 being indicated.

FIG. 3 shows a wrapping sheet 110 according to the present invention, showing the zones which respectively cooperate with the walls of the structured assembly 12 to define the airtight wrapper 10.

FIG. 3 indicates, adjacent to each other along the longitudinal development L of the wrapping sheet 110, a first larger panel 131, which will define part of the larger front lateral wall 31, a first smaller panel 135, which will define the upper wall 35, a second larger panel 134, which will define the larger rear lateral wall 34, and a second smaller panel 136, which will define the lower wall 36 of the airtight wrapper 10.

The wrapping sheet 110 also comprises a lower flap 137, connected to the second larger panel 134 by the second smaller panel 136, and an upper flap 138 connected to the first larger panel 131 which, welded together, will define the transverse edge 37.

Furthermore, the embodiment shown in FIG. 3 also indicates, on the sides of the larger panels 131, 134, respective front longitudinal flaps 132, 133, and rear 132', 133', and on the sides of the smaller panels 135, 136 respective upper 139 and lower 140 transverse flaps which, suitably folded and overlapping each other as described below, will define the smaller lateral walls 32, 33.

The wrapping sheet 110 can also provide, within its perimeter, and in a suitable position, an opening pre-cutting line 115 suitable to define, in the airtight wrapper 10 during use, the extraction aperture through which it is possible to access the smoking articles 14 contained in it.

According to some embodiments, the extraction aperture can be temporarily closed by means of a label, or a tab 27, possibly of the adhesive type, and reusable.

According to one aspect of the present invention, at least two cuts 145 are made on the wrapping sheet 110 so as to separate the lower flap 137 from the respective lower transverse flaps 140.

The cuts 145, in particular, define, in the lower flap 137, a central portion 137*a*, connected to the second smaller panel 136 in correspondence with a transverse folding line 151, and two lateral fins 137*b*, disposed on opposite sides of the central portion 137*a*, and separated by the respective lower transverse flaps 140.

According to some embodiments, the cuts 145 can be made in continuity with the transverse folding line 151 which is formed between the second smaller panel 136 and the lower flap 137.

According to some embodiments, the cuts 145 extend from opposite sides of the wrapping sheet 110 substantially from respective joint vertices V between the second smaller panel 136, the lower flap 137 and a respective lower transverse flap 140 as far as the external edge of the wrapping sheet 110 itself.

According to some embodiments, the cuts 145 are made parallel and in continuity with the transverse folding line 151.

According to variant embodiments, the cuts 145 are inclined with respect to the transverse folding line 151 by an acute angle α.

The cuts 145 disposed at an acute angle α allow to compensate possible misalignments, or inclinations, of the wrapping sheet 110 during the making of the cuts 145 themselves, or misalignments of the wrapping sheet 110 with respect to the structured assembly 12 when it is associated with it.

According to possible solutions, the acute angle α can be comprised between about 2° and about 15°.

According to possible variant embodiments, the acute angle α can be comprised between about 5° and about 10°.

According to some solutions, the cuts 145 are made symmetrical to each other with respect to a median longitudinal axis L of the wrapping sheet 110.

FIGS. 4*a* to 4*f* are used to describe successive steps of a method to make an airtight wrapper 10 starting from a wrapping sheet 110.

The wrapping sheet 110, 120 is preferably made of a weldable material, for example a heat-weldable material, or a material that can be welded by ultrasound or induction.

The method to make an airtight wrapper 10 according to the invention provides to fold the wrapping sheet 110 in a U shape, and to position it so as to wrap the structured assembly 12 on three sides.

According to some embodiments, the wrapping sheet 110 is disposed in an asymmetric position with respect to the structured assembly 12, with the lower flap 137 offset with respect to the upper flap 138 (FIG. 4*a*).

According to some embodiments, the lower flap 137 can protrude beyond the upper flap 138 by a length coherent with the height of the bottom wall 26 of the structured assembly 12.

In particular, the wrapping sheet 110 is positioned with the first smaller panel 135 in contact with the smaller head wall 25, and with the larger panels 131, 134 in contact with the larger front wall 21 and rear wall 24, respectively.

The lower 137 and upper 138 flaps, the longitudinal flaps 132, 132', 133, 133', and the upper transverse flaps 139 protrude beyond the edges of the structured assembly 12.

In particular, the upper flap 138 and the lower flap 137 protrude beyond the smaller bottom wall 26, the upper transverse flaps 139 protrude laterally from the lower head wall 25, and the rear longitudinal flaps 132', 133' and front 132, 133 protrude beyond the respective smaller lateral walls 22, 23.

The method according to the invention provides to move the lower flap 137 closer, to bring it into contact with the upper flap 138, and to weld them to each other in such a way as to define the transverse edge 37, disposed substantially aligned and in continuity with the first larger panel 131 (FIG. 4*b*).

In this way the second smaller panel 136 is defined, adjacent to the bottom wall 26 of the structured assembly 12, which is thus completely surrounded on four sides.

The second smaller panel 136 is then folded with respect to the second larger panel 134 and to the lower flap 137, to which it is connected by the transverse folding line 151.

Thanks to the presence of the cuts 145, after the transverse edge 37 has been welded, the transverse flaps 139, 140, and the longitudinal flaps 132, 132', 133, 133' beyond the edges of the structured assembly 12 substantially define a ring shape, open at least in correspondence with the cuts 145.

The method according to the invention also provides to fold the upper transverse flaps 139 of the wrapping sheet 110 which protrude laterally in a transverse direction from the head wall 25 of the structured assembly 12, taking each of them into contact with a respective smaller lateral wall 22, 23.

According to some embodiments, during the folding of the upper transverse flaps 139, the method provides to make upper triangular-like folds 152 in correspondence with both the front 17 and rear 18 corners of the structured assembly 12, defined respectively between the larger front wall 2, and rear wall 24, and a respective smaller lateral wall 22, 23 (FIG. 4*b*).

According to some embodiments, the upper transverse flaps 139 are folded before the transverse edge 37 is made and/or welded.

According to possible variants, the upper transverse flaps 139 can be folded after the transverse edge 37 is made and/or welded, or even while it is being made and/or welded.

After welding the transverse edge 37, the method provides to fold it on the first larger panel 131 and on the front longitudinal flaps 132, 133, rotating it by 180° with respect to the transverse folding line 151 (FIG. 4*c*).

In this way, the upper flap 138 is in an intermediate position between the first larger panel 131 and/or a respective front longitudinal flap 132, 133 on one side, and the lower flap 137 on the other.

According to some embodiments, the method according to the invention then provides to fold the opposite lower transverse flaps 140 of the wrapping sheet 110, which protrude laterally in a transverse direction from the bottom wall 26 of the structured assembly 12 toward the lateral walls 22, 23 thereof (FIG. 4*d*).

In particular, the method according to the invention provides to fold each lower transverse flap 140 toward a respective lateral wall 22, 23 of the structured assembly 12, possibly providing a lower triangular-like fold 153 on each lateral wall 22, 23 only in correspondence with the rear corner 18 of the structured assembly 12.

Thanks to the presence of the cuts 145, in fact, the lower transverse flaps 140 are separated by the transverse edge 37, and in particular by the lateral fins 137*b* of the lower flap 137, and therefore the transverse flap 37 remains stationary in the position folded at 180°, as previously assumed, and does not follow the movement of the lower transverse flaps 140 toward the lateral walls 22, 23, which are then folded autonomously and independently.

This allows to fold the lower transverse flaps 140 quickly and uniformly, without the risk of unwanted folds being formed or of creating a "wrinkled" effect due to the presence of the transverse edge 37 because of the thickness and rigidity of the latter, following welding.

Subsequently, the method according to the invention provides to fold the rear longitudinal flaps 132', 133' toward the smaller lateral walls 22, 23 of the structured assembly 12, taking them respectively into contact with a respective upper transverse 139 and lower transverse flap 140 (FIG. 4*e*).

The method according to the invention also provides to fold the front longitudinal flaps 132, 133, together with the lateral fins 137*b* of the transverse edge 37 associated therewith, overlapping them over the longitudinal rear flaps 132', 133', already folded.

Finally, the method provides to weld the front longitudinal flaps 132, 133, and the lateral fins 137*b* of the transverse edge 37 laterally to the respective rear longitudinal flaps 132', 133' and transverse flaps 139, 140, disposed between them and the structured assembly 12 (FIG. 4*f*).

In this way an airtight wrapper 10 is defined, of the type shown by way of example in FIG. 1, provided with a transverse edge 37 folded so as to partly wrap the front wall 31 and the lateral walls 32, 33, wherein the transverse edge 37 has a protruding portion 39 which protrudes beyond the lower edge of the lower wall 36.

Figure 5:
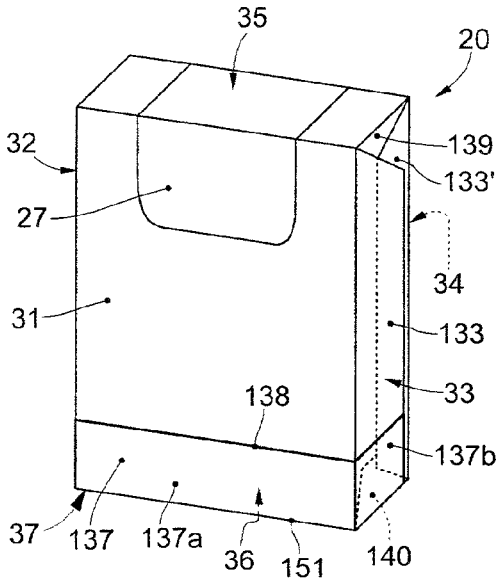
FIG. 5 is a schematic three-dimensional view of a variant of an airtight wrapper according to embodiments described here.
Figure 6:
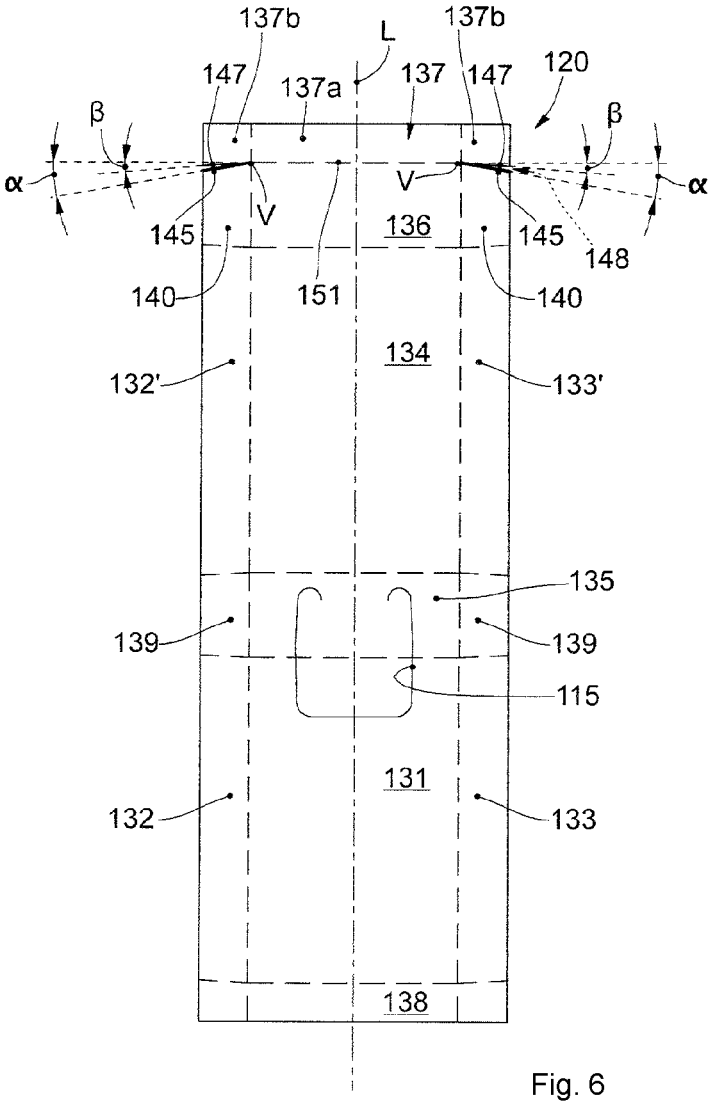
FIG. 6 is a schematic view of a variant of a wrapping sheet which can be used to make the airtight wrapper in FIG. 5 with the flaps and folds that form during folding around the structured assembly in FIG. 2 being indicated.

FIGS. 5 and 6 are used to describe, respectively, a variant embodiment of an airtight wrapper 20 and a corresponding wrapping sheet 120 used to make it. The elements that are identical to those in the embodiments of FIGS. 1 and 3 are indicated with the same reference numbers and are not further described.

The wrapping sheet 120 according to the embodiment in FIG. 6 differs from the wrapping sheet 110 according to the embodiment in FIG. 3 in that, in addition to the cuts 145, it comprises incisions, or cutting lines 147, which, together with the cuts 145, form cut portions 148.

The cutting lines 147 are disposed on one side and the other side of the wrapping sheet 110, symmetrical to each other with respect to the longitudinal axis L.

According to some embodiments, the cutting lines 147 and the cuts 145 intersect in correspondence with the vertices V defined by the second smaller panel 136, the lower flap 137 and a respective lower transverse flap 140.

According to these embodiments, the cuts 145 are made inclined, with respect to the transverse folding line 151, by the acute angle $\alpha$, greater than zero.

According to some embodiments, the cutting lines 147 can be made in continuity with the transverse folding line 151, possibly inclined by an angle $\beta$, smaller than the angle $\alpha$, with respect to said transverse folding line 151.

According to some embodiments, the angle $\beta$ can be greater than, or even equal to zero.

Providing the cutting lines 147 allows to eliminate, or at least reduce, the sizes of the protruding portions 39 in the airtight wrapper 20.

In this way, when the wrapping sheet 120 is folded and welded around the structured assembly 12, in correspondence with the lower portion of the lateral walls 22, 23, the lateral fins 137*b* are substantially flush with the edge of the lower wall 36 and there are no protruding portions 39 that protrude beyond the lateral edge of the latter.

It is clear that modifications and/or additions of parts can be made to the method to make an airtight wrapper and the airtight wrapper 10, 20 described heretofore, without departing from the field and scope of the present invention.

For example, according to other embodiments, not shown, which can be combined with the embodiments described previously, it is also possible to provide cuts, or cutting lines, in correspondence with the folding line between each lower transverse flap 140 and the respective rear longitudinal flap 132', 133'.

In this case, during the folding of the lower transverse flaps 140 toward the lateral walls 22, 23, no lower triangular-like fold 153 is formed, in that the lower transverse flaps 140 rest flat and lying on the lateral walls 22, 23 and the rear longitudinal flaps 132', 133' also rest flat and lying on the lower transverse flaps 140.

Moreover, according to other variant embodiments, not shown, and combinable with the embodiments described previously, it is also possible to provide cuts, or cutting lines, in correspondence with one or both of the sides of the upper transverse flaps 139, separating them from the respective front longitudinal flaps 132, 133 and/or rear longitudinal flaps 132', 133', so as to increase the reciprocal contact area between the upper transverse flaps 139 and the longitudinal flaps 132, 132', 133, 133 when overlapping each other.

In this case, only one or no upper triangular-like fold 152 can be defined on the front 17 and rear corners 18, depending on the side/s of the upper transverse flaps 139 affected by the cutting lines.

In fact, the upper transverse flaps 139, if provided with cuts, extend at least on one side flat and lying on the lateral walls 32, 33 and the rear longitudinal flaps 132', 133' and front longitudinal flaps 132, 133 in correspondence with the side affected by the cuts, rest flat and lying on the transverse flaps 139, 140 and/or longitudinal flaps 132', 133' previously folded.

It is also clear that, although the present invention has been described with reference to some specific examples, a person of skill in the art shall certainly be able to achieve many other equivalent forms of method to make an airtight wrapper and the airtight wrapper 10, 20, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. A method to make an airtight wrapper having a structured assembly completely wrapped by a wrapping sheet made of a weldable material, said structured assembly having a group of smoking articles partly wrapped by a reinforcement insert, said method comprising:

positioning the wrapping sheet, folded to a "U" shape, with respect to the structured assembly, so as to define a first larger panel and a second larger panel of said wrapping sheet in contact with respective larger walls, front and rear, of said structured assembly, and a first smaller panel of said wrapping sheet in contact with a smaller head wall of said structured assembly, wherein said wrapping sheet, once positioned with respect to the structured assembly, respectively has:

an upper flap connected to said first larger panel and a lower flap connected to said second larger panel, said upper flap and said lower flap protruding beyond a smaller bottom wall of said structured assembly, upper transverse flaps, connected to said first smaller panel, and protruding laterally from said smaller head wall, rear, and front longitudinal flaps, respectively connected laterally to said first larger panel and to said second larger pane and which protrude beyond respective smaller lateral walls of said structured assembly;

bringing said lower flap and said upper flap nearer to each other and welding them to each other, defining:

a transverse edge formed by the welded lower flap and upper flap, disposed substantially aligned with said larger front wall, a second smaller panel disposed folded, adjacent to said smaller bottom wall, between said second larger panel and said lower flap to which it is connected by a transverse folding line, lower transverse flaps, connected to said second smaller panel, and protruding laterally from said smaller bottom wall and opposite said upper transverse flaps;

folding said transverse edge on said first larger panel and on said front longitudinal flaps, rotating said transverse edge by 180° along said transverse folding line toward said larger front wall of said structured assembly;

folding the upper and lower transverse flaps toward said smaller lateral walls;

folding the rear and front longitudinal flaps toward said smaller lateral walls, overlapping one on top of the other, and also part of said transverse edge, above said transverse flaps, and welding said rear and front longitudinal flaps with respect to each other to seal said airtight wrapper, wherein said method further comprises:

making at least two cuts in said wrapping sheet, defining two free lateral fins and a central portion of said lower flap, said at least two cuts being made in a position such as to separate, before folding the lower transverse flaps toward said smaller lateral wall, said lower flap from the respective lower transverse flaps, so as to be able to fold said lower transverse flaps freely with respect to said transverse edge, wherein, during the folding of said front longitudinal flaps, said lateral fins of said transverse edge overlap in a planar and extended shape, without substantial deformations, on said longitudinal flaps.

2. The method as in claim 1, and including making on said wrapping sheet cutting lines that intersect said at least two cuts and form cut portions.

3. The method as in claim 1, wherein said at least two cuts are made before positioning said wrapping sheet on said structured assembly.

4. The method as in claim 1, wherein said at least two cuts are made after positioning said wrapping sheet around said structured assembly and before the folding of said lower transverse flaps.

5. The method as in claim 1, wherein said at least two cuts are made in association with said transverse folding line.

6. The method as in claim 1, wherein at least two cuts have an inclination with respect to said transverse folding line of an acute angle, larger than zero, and are symmetrical to each other with respect to a median longitudinal axis of said wrapping sheet.

7. The method as in claim 6, wherein said cutting lines are made inclined with respect to said transverse folding line by an angle, smaller than said acute angle, wherein said smaller angle is larger than or equal to zero.

8. The method as in claim 1, and including making further cuts, or cutting lines, between each lower transverse flap and the respective rear longitudinal flap.

9. The method as in claim 1, and including making further cuts, or cutting lines, in correspondence with one or both sides of said upper transverse flaps, separating them from one or both the respective front and/or rear longitudinal flaps.

10. Method as in claim 1, wherein at least two transverse flaps rest in a flat and extended shape on the respective lateral walls of said structured assembly.

11. An airtight wrapper comprising: a structured assembly completely wrapped by a wrapping sheet made of a weldable material, said structured assembly comprising a group of smoking articles partly wrapped by a reinforcement insert, said airtight wrapper comprising larger front and rear lateral walls, parallel and opposite each other and connected, on one side, by smaller lateral walls parallel and opposite each other, and on the other side, to a respective upper and lower wall, parallel and opposite each other, wherein said airtight wrapper comprises a transverse edge folded on said larger front lateral wall and formed by a lower flap and an upper flap of said wrapping sheet, welded overlapping one another, wherein said lower flap comprises a central portion connected to said lower wall and lateral fins disposed on one side and the other of said central portion and separated by a cut from respective lower transverse flaps arranged laterally from said lower wall and folded on said smaller lateral wall, wherein said lateral fins are folded on said smaller lateral walls and overlap without substantial deformations, on said smaller lateral walls.

12. The airtight wrapper as in claim 11, wherein said smaller lateral walls are made by respective transverse flaps and longitudinal flaps overlapping each other, wherein at least two transverse flapsare folded on the respective lateral walls of said structured assembly and at least a pair of respective rear and/or front longitudinal flaps overlap in a flat and extended shape on said previously folded transverse flaps.

13. An airtight wrapper for a group of smoking articles, comprising:

a wrapping sheet made of a single sheet of weldable material and configured to wrap the group of smoking articles, said wrapping sheet comprising:

a large front panel and a large rear panel comprising a front wall and a rear wall, respectively, the front wall and the rear wall arranged to be positioned parallel and opposite each other when wrapping the group of smoking articles;

a first smaller panel separating the front and rear walls and configured to form an upper flap when wrapping the group of smoking articles;

a second smaller panel extending from either the first large panel or the second large panel and configured to form a lower flap opposite and parallel to the upper flap when wrapping the group of smoking articles, the lower flap and the upper flap extending from the second smaller panel and either the first or the second large panel, from which the second bottom panel is not extending, the lower flap and the upper flap being configured to be welded when overlapping each other to be folded onto the front wall or the rear wall when wrapping the group of smoking articles;

wherein the lower flap that extends from the bottom panel comprises a central portion connected to the second smaller panel along a transverse folding line;

a pair of fins, each of the fins protruding laterally from a corresponding side of the central portion, each of the fins being separated from an adjacent transverse flap by a cut protruding laterally from each side of the second smaller panel, and wherein said lower and bottom lateral fins are configured to overlap a corresponding adjacent transverse flap when wrapping the group of smoking articles.

14. The airtight wrapper as in claim 13, wherein the cut is formed at an acute angle with respect to the transverse folding line.

* * * * *